US006321509B1

(12) United States Patent
DelDuca et al.

(10) Patent No.: US 6,321,509 B1
(45) Date of Patent: Nov. 27, 2001

(54) METHOD AND APPARATUS FOR INSERTING AN OXYGEN SCAVENGER INTO A MODIFIED ATMOSPHERE PACKAGE

(75) Inventors: Gary R. DelDuca, Canandaigua; Stephen L. Goulette, Newark; Darryl P. Hansen, Shortsville; Vinod K. Luthra, Pittsford, all of NY (US)

(73) Assignee: Pactiv Corporation, Lake Forest, IL (US)

( * ) Notice: Subject to any disclaimer, the term of this patent is extended or adjusted under 35 U.S.C. 154(b) by 0 days.

(21) Appl. No.: 09/332,623

(22) Filed: Jun. 11, 1999

(51) Int. Cl.[7] ..... B65B 31/04; B65B 29/00

(52) U.S. Cl. ..... 53/400; 53/55; 53/111 RC; 53/433; 53/511; 252/188.28

(58) Field of Search ..... 53/400, 401, 410, 53/449, 450, 433, 511, 135.3, 173, 550, 111 RC, 55, 155, 445; 252/188.28

(56) References Cited

U.S. PATENT DOCUMENTS

| | | |
|---|---|---|
| 1,475,396 | 11/1923 | Kestner . |
| 1,679,543 | 8/1928 | Rector . |
| 2,732,092 | 1/1956 | Lawrence . |
| 2,825,651 | 3/1958 | Loo et al. . |

(List continued on next page.)

FOREIGN PATENT DOCUMENTS

| | | |
|---|---|---|
| 0 457 457 A2 | 11/1991 | (EP) . |
| 0468880 A1 | 1/1992 | (EP) . |
| 0 547 761 A1 | 6/1993 | (EP) . |
| 1 556 853 | 11/1979 | (GB) . |
| 6278774 | 10/1994 | (JP) . |
| 6343815 | 12/1994 | (JP) . |

OTHER PUBLICATIONS

Application: 924298; Jun. 12, 1992; De Muelenaere et al.

Gill, "Extending the Storage Life of Raw Chilled Meats," Agriculture and Agri–Food Canada Research Centre.

Gill et al., "The Use of Oxygen Scavengers to Prevent the Transient Discolouration of Ground Beef Packaged Under Controlled, Oxygen–depleted Atmospheres," *Meat Science* 41(1):19–27 (1995).

(List continued on next page.)

*Primary Examiner*—Stephen F. Gerrity
(74) *Attorney, Agent, or Firm*—Jenkens & Gilchrist

(57) ABSTRACT

A unique method and apparatus for inserting an oxygen scavenger into a modified atmosphere package for extending the shelf life of food, especially raw meats. A scavenger feeder feeds a chain of interconnected oxygen scavengers. A separator separates the oxygen scavenger located at an exposed end of the chain of interconnected oxygen scavengers from the chain of interconnected oxygen scavengers. An adhesive applicator applies adhesive to the oxygen scavenger which has been separated from the chain of interconnected oxygen scavengers. A conveyor conveys the separated oxygen scavenger to a position which is adjacent to a film layer which is used to form an outer package of the modified atmosphere package so that the oxygen scavenger is attached to a surface of the film layer by the adhesive. The film layer is subsequently formed into the outer package so that the oxygen scavenger that is attached to the film layer is contained within the outer package. Optionally, an injector injects the oxygen scavenger at the exposed end of the chain of interconnected oxygen scavengers with an oxygen uptake accelerator to activate the oxygen scavenger prior to separating the oxygen scavenger from the chain of interconnected oxygen scavengers. The modified atmosphere package comprises the outer package, the oxygen scavenger, and any food-filled inner package which is inserted into the outer package.

29 Claims, 3 Drawing Sheets

U.S. PATENT DOCUMENTS

| | | | |
|---|---|---|---|
| 3,083,861 | | 4/1963 | Amberg et al. . |
| 3,363,395 | | 1/1968 | King . |
| 3,419,400 | | 12/1968 | Hayhurst et al. . |
| 3,467,244 | | 9/1969 | Mahaffy et al. . |
| 3,481,100 | | 12/1969 | Bergstrom . |
| 3,545,163 | | 12/1970 | Mahaffy et al. . |
| 3,574,642 | | 4/1971 | Weinke . |
| 3,587,839 | | 6/1971 | Von Brecht et al. . |
| 3,634,993 | | 1/1972 | Pasco et al. . |
| 3,650,775 | | 3/1972 | Simon et al. . |
| 3,679,093 | | 7/1972 | Chang . |
| 3,686,822 | | 8/1972 | Wolfelsperger . |
| 3,750,362 | | 8/1973 | Kishpaugh et al. . |
| 3,788,369 | | 1/1974 | Killinger . |
| 3,792,181 | | 2/1974 | Mahaffy et al. . |
| 3,843,806 | | 10/1974 | Kishpaugh et al. . |
| 3,851,441 | | 12/1974 | Marchand . |
| 3,903,309 | | 9/1975 | Mahaffy et al. . |
| 4,083,372 | | 4/1978 | Boden . |
| 4,102,803 | * | 7/1978 | Fujishima et al. ..... 252/188.28 |
| 4,127,503 | | 11/1978 | Yoshikawa et al. . |
| 4,141,487 | | 2/1979 | Faust et al. . |
| 4,166,807 | | 9/1979 | Komatsu et al. . |
| 4,192,773 | | 3/1980 | Yoshikawa et al. . |
| 4,201,030 | | 5/1980 | Mahaffy et al. . |
| 4,230,595 | | 10/1980 | Yamaji et al. . |
| 4,242,659 | | 12/1980 | Baxter et al. . |
| 4,299,719 | | 11/1981 | Aoki et al. . |
| 4,308,711 | | 1/1982 | Mahaffy et al. . |
| 4,317,742 | | 3/1982 | Yamaji et al. . |
| 4,337,276 | | 6/1982 | Nakamura et al. . |
| 4,340,138 | | 7/1982 | Bernhardt . |
| 4,349,999 | | 9/1982 | Mahaffy et al. . |
| 4,366,179 | | 12/1982 | Nawata et al. . |
| 4,384,972 | | 5/1983 | Nakamura et al. . |
| 4,406,813 | | 9/1983 | Fujishima et al. . |
| 4,411,122 | | 10/1983 | Cornish et al. . |
| 4,411,918 | | 10/1983 | Cimino et al. . |
| 4,424,659 | | 1/1984 | Perigo et al. . |
| 4,454,945 | | 6/1984 | Jabarin et al. . |
| 4,510,162 | | 4/1985 | Nezat . |
| 4,517,206 | | 5/1985 | Murphy et al. . |
| 4,524,015 | | 6/1985 | Takahashi et al. . |
| 4,536,409 | | 8/1985 | Farrell et al. . |
| 4,543,770 | | 10/1985 | Walter et al. . |
| 4,564,054 | | 1/1986 | Gustavsson . |
| 4,574,174 | | 3/1986 | McGonigle . |
| 4,579,223 | | 4/1986 | Otsuka et al. . |
| 4,581,764 | | 4/1986 | Plock et al. . |
| 4,588,561 | | 5/1986 | Aswell et al. . |
| 4,593,816 | | 6/1986 | Langenbeck . |
| 4,622,229 | | 11/1986 | Toshitsugu . |
| 4,622,239 | | 11/1986 | Schoenthaler et al. . |
| 4,642,239 | | 2/1987 | Ferrar et al. . |
| 4,645,073 | | 2/1987 | Homan . |
| 4,657,610 | | 4/1987 | Komatsu et al. . |
| 4,661,326 | | 4/1987 | Schainholz . |
| 4,683,139 | | 7/1987 | Cheng . |
| 4,683,702 | | 8/1987 | Vis . |
| 4,685,274 | | 8/1987 | Garwood . |
| 4,704,254 | | 11/1987 | Nichols . |
| 4,711,741 | | 12/1987 | Fujishima et al. . |
| 4,728,504 | | 3/1988 | Nichols . |
| 4,737,389 | | 4/1988 | Hartsing, Jr. et al. . |
| 4,740,402 | | 4/1988 | Maeda et al. . |
| 4,756,436 | | 7/1988 | Morita et al. . |
| 4,762,722 | | 8/1988 | Izumimoto et al. . |
| 4,765,499 | | 8/1988 | von Reis et al. . |
| 4,769,175 | | 9/1988 | Inoue . |
| 4,783,321 | | 11/1988 | Spence . |
| 4,820,442 | | 4/1989 | Motoyama et al. . |
| 4,830,855 | | 5/1989 | Stewart . |
| 4,830,863 | | 5/1989 | Jones . |
| 4,836,952 | | 6/1989 | Nasu et al. . |
| 4,840,271 | | 6/1989 | Garwood . |
| 4,842,875 | | 6/1989 | Anderson . |
| 4,876,146 | | 10/1989 | Isaka et al. . |
| 4,877,664 | | 10/1989 | Maeda et al. . |
| 4,897,274 | | 1/1990 | Candida et al. . |
| 4,907,393 | * | 3/1990 | Omori . |
| 4,908,151 | | 3/1990 | Inoue et al. . |
| 4,910,032 | | 3/1990 | Antoon, Jr. . |
| 4,923,703 | | 5/1990 | Antoon, Jr. . |
| 4,928,474 | | 5/1990 | Schirmer . |
| 4,942,048 | | 7/1990 | Nasu et al. . |
| 4,943,440 | | 7/1990 | Armstrong . |
| 4,949,847 | | 8/1990 | Nagata . |
| 4,952,451 | | 8/1990 | Mueller . |
| 4,956,209 | | 9/1990 | Isaka et al. . |
| 4,992,410 | | 2/1991 | Cullen et al. . |
| 4,996,068 | | 2/1991 | Hatakeyama et al. . |
| 5,019,212 | | 5/1991 | Morita et al. . |
| 5,021,515 | | 6/1991 | Cochran et al. . |
| 5,025,611 | | 6/1991 | Garwood . |
| 5,045,331 | | 9/1991 | Antoon, Jr. . |
| 5,049,624 | | 9/1991 | Adams et al. . |
| 5,064,698 | | 11/1991 | Courtright et al. . |
| 5,084,290 | * | 1/1992 | Morita et al. . |
| 5,085,878 | | 2/1992 | Hatakeyama et al. . |
| 5,096,724 | | 3/1992 | Zenner et al. . |
| 5,101,611 | | 4/1992 | Biskup et al. . |
| 5,103,618 | | 4/1992 | Garwood . |
| 5,108,649 | | 4/1992 | Matsumoto et al. . |
| 5,110,677 | | 5/1992 | Barmore et al. . |
| 5,112,674 | | 5/1992 | German et al. . |
| 5,115,624 | | 5/1992 | Garwood . |
| 5,116,660 | | 5/1992 | Komatsu et al. . |
| 5,120,349 | | 6/1992 | Stewart et al. . |
| 5,120,585 | | 6/1992 | Sutter et al. . |
| 5,124,164 | | 6/1992 | Matsumoto et al. . |
| 5,128,060 | | 7/1992 | Ueno et al. . |
| 5,129,512 | | 7/1992 | Garwood . |
| 5,132,151 | | 7/1992 | Graney . |
| 5,135,787 | | 8/1992 | Bair . |
| 5,143,763 | | 9/1992 | Yamada et al. . |
| 5,143,769 | | 9/1992 | Moriya et al. . |
| 5,145,950 | | 9/1992 | Funaki et al. . |
| 5,151,331 | | 9/1992 | Beeson et al. . |
| 5,153,038 | | 10/1992 | Koyama et al. . |
| 5,155,974 | | 10/1992 | Garwood . |
| 5,157,902 | * | 10/1992 | Hatakeyama . |
| 5,158,537 | | 10/1992 | Haak et al. . |
| 5,171,593 | | 12/1992 | Doyle . |
| 5,176,849 | | 1/1993 | Hwa et al. . |
| 5,176,930 | | 1/1993 | Kannankeril et al. . |
| 5,194,315 | | 3/1993 | Itoh . |
| 5,202,052 | | 4/1993 | Zenner et al. . |
| 5,204,389 | | 4/1993 | Hofeldt et al. . |
| 5,207,943 | | 5/1993 | Cullen et al. . |
| 5,211,875 | | 5/1993 | Speer et al. . |
| 5,223,146 | * | 6/1993 | Kreh . |
| 5,226,531 | | 7/1993 | Garwood . |
| 5,226,735 | | 7/1993 | Beliveau . |
| 5,227,411 | | 7/1993 | Hofeldt et al. . |
| 5,236,617 | | 8/1993 | Ueno et al. . |
| 5,239,016 | | 8/1993 | Cochran et al. . |
| 5,241,149 | | 8/1993 | Watanabe et al. . |
| 5,242,111 | | 9/1993 | Nakoneczny et al. . |
| 5,244,600 | | 9/1993 | Cuisia et al. . |
| 5,247,746 | | 9/1993 | Johnson et al. . |
| 5,250,310 | | 10/1993 | Fujino et al. . |

| | | | |
|---|---|---|---|
| 5,254,354 | | 10/1993 | Stewart . |
| 5,258,537 | | 11/1993 | Takeuchi et al. . |
| 5,262,375 | | 11/1993 | McKedy . |
| 5,270,337 | | 12/1993 | Graf . |
| 5,284,871 | | 2/1994 | Graf . |
| 5,286,407 | | 2/1994 | Inoue et al. . |
| 5,288,907 | | 2/1994 | Sherwin et al. . |
| 5,290,268 | | 3/1994 | Oliver et al. . |
| 5,296,291 | | 3/1994 | Mueller . |
| 5,310,497 | | 5/1994 | Ve Speer et al. . |
| 5,320,598 | | 6/1994 | Haak et al. . |
| 5,323,590 | | 6/1994 | Garwood . |
| 5,332,590 | | 7/1994 | McKedy . |
| 5,334,405 | | 8/1994 | Gorlich . |
| 5,346,312 | | 9/1994 | Mabry et al. . |
| 5,346,644 | | 9/1994 | Speer et al. . |
| 5,348,752 | | 9/1994 | Gorlich . |
| 5,350,622 | | 9/1994 | Speer et al. . |
| 5,364,555 | | 11/1994 | Zenner et al. . |
| 5,364,669 | | 11/1994 | Sumida et al. . |
| 5,378,428 | | 1/1995 | Inoue et al. . |
| 5,384,103 | | 1/1995 | Miller . |
| 5,390,475 | | 2/1995 | Iwauchi et al. . |
| 5,399,289 | | 3/1995 | Speer et al. . |
| 5,409,126 | | 4/1995 | DeMars . |
| 5,425,896 | | 6/1995 | Speer et al. . |
| 5,443,727 | | 8/1995 | Gagnon . |
| 5,445,607 | | 8/1995 | Venkateshwaran et al. . |
| 5,481,852 | * | 1/1996 | Mitchell . |
| 5,491,019 | | 2/1996 | Kuo . |
| 5,492,705 | | 2/1996 | Porchia et al. . |
| 5,492,742 | | 2/1996 | Zenner et al. . |
| 5,498,364 | | 3/1996 | Speer et al. . |
| 5,507,379 | | 4/1996 | Mazur et al. . |
| 5,510,166 | | 4/1996 | Inoue et al. . |
| 5,514,392 | | 5/1996 | Garwood . |
| 5,529,833 | | 6/1996 | Speer et al. . |
| 5,564,974 | | 10/1996 | Mazur et al. . |
| 5,580,573 | | 12/1996 | Kydonieus et al. . |
| 5,585,129 | | 12/1996 | Geddes et al. . |
| 5,603,413 | | 2/1997 | Mitchum, Jr. . |
| 5,608,643 | | 3/1997 | Wichter et al. . |
| 5,631,036 | | 5/1997 | Davis . |
| 5,638,660 | | 6/1997 | Kuo . |
| 5,639,815 | | 6/1997 | Cochran et al. . |
| 5,643,625 | | 7/1997 | Perry et al. . |
| 5,648,020 | | 7/1997 | Speer et al. . |
| 5,660,761 | | 8/1997 | Katsumoto et al. . |
| 5,665,822 | | 9/1997 | Bitler et al. . |
| 5,667,827 | | 9/1997 | Breen et al. . |
| 5,667,863 | | 9/1997 | Cullen et al. . |
| 5,672,406 | | 9/1997 | Challis et al. . |
| 5,686,126 | | 11/1997 | Noel et al. . |
| 5,686,127 | | 11/1997 | Stockley, III et al. . |
| 5,698,250 | | 12/1997 | DelDuca et al. . |
| 5,700,554 | | 12/1997 | Speer et al. . |
| 5,711,978 | | 1/1998 | Breen et al. . |
| 5,715,169 | | 2/1998 | Noguchi . |
| 5,744,246 | * | 4/1998 | Ching . |
| 5,766,706 | * | 6/1998 | Custer et al. . |
| 5,811,142 | | 9/1998 | DelDuca et al. . |
| 5,928,560 | * | 7/1999 | DelDuca et al. . |

OTHER PUBLICATIONS

Labell, "Controlled & Modified Atmosphere Packaging, Methods for Extending Shelf Life of a Variety of Food Products," *Food Processing*, Jan. (1985) pp. 152–154.

Ledward, "Metmyoglobin Formation in Beef Stored in Carbon Dioxide Enriched and Oxygen Depleted Atmospheres," *Journal of Food Science* 35:33–37 (1970).

Muller, "Longer Product Shelf Life Using Modified Atmosphere Packaging," *The National Provisioner*, Feb. (1986) pp. 19–22.

Brochure; "M–Tek Case–Ready Systems," M–Tek Inc., Elgin, Illinois, date unknown.

* cited by examiner

Fig. 3
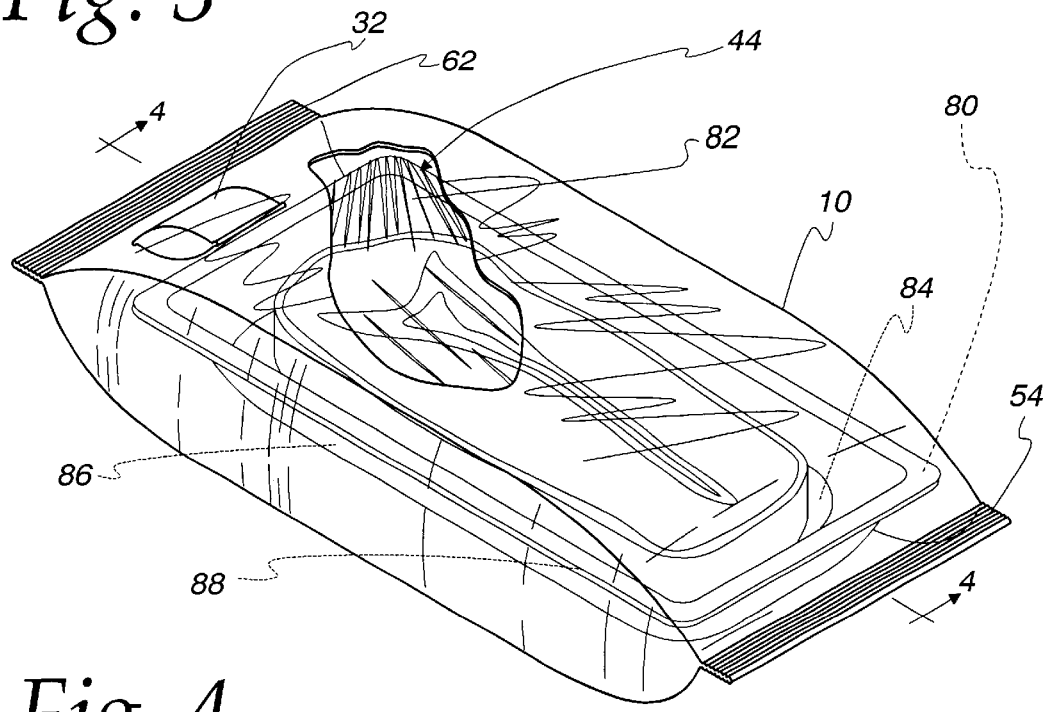
Fig. 4
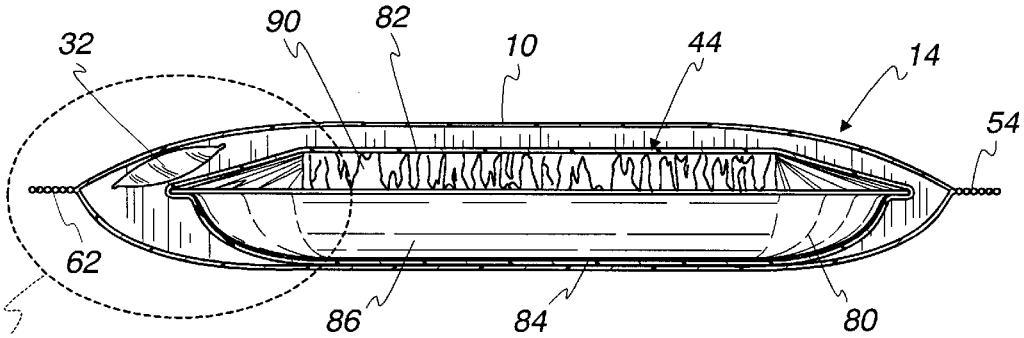
Fig. 5
Fig. 5
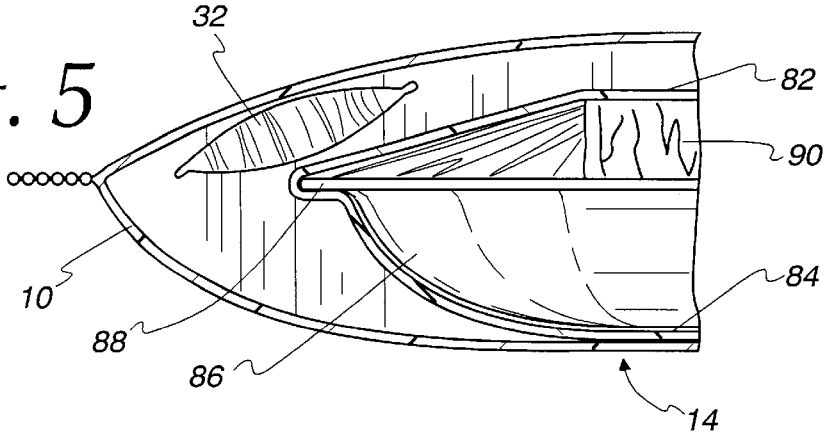

METHOD AND APPARATUS FOR INSERTING AN OXYGEN SCAVENGER INTO A MODIFIED ATMOSPHERE PACKAGE

FIELD OF THE INVENTION

The present invention relates generally to inserting an oxygen scavenger into a modified atmosphere package for storing food. More particularly, the invention relates to a method and apparatus for inserting an oxygen scavenger into a modified atmosphere package for extending the shelf life of raw meats or other food stored therein.

BACKGROUND OF THE INVENTION

Containers have long been employed to store and transfer perishable food prior to presenting the food at a market where it will be purchased by the consumer. After perishable foods, such as meats, fruits, and vegetables, are harvested, they are placed into containers to preserve those foods for as long as possible. Maximizing the time in which the food remains preserved in the containers increases the profitability of all entities in the chain of distribution by minimizing the amount of spoilage.

The environment around which the food is preserved is a critical factor in the preservation process. Not only is maintaining an adequate temperature important, but the molecular and chemical content of the gases surrounding the food is significant as well. By providing an appropriate gas content to the environment surrounding the food, the food can be better preserved when maintained at the proper temperature or even when it is exposed to variations in temperature. This gives the food producer some assurance that after the food leaves his or her control, the food will be in an acceptable condition when it reaches the consumer.

Modified atmosphere packaging systems for one type of food, raw meats, expose these raw meats to either extremely high levels or extremely low levels of oxygen ($O_2$). Packaging systems which provide extremely low levels of oxygen are generally preferable because it is well known that the fresh quality of meat can be preserved longer under anaerobic conditions than under aerobic conditions. Maintaining low levels of oxygen minimizes the growth and multiplication of aerobic bacteria.

One example of a low-level oxygen system is disclosed in U.S. Pat. No. 5,698,250 to DelDuca et al. In the DelDuca system, an oxygen reduction technique such as gas flushing is used to initially remove most of the oxygen from a modified atmosphere package containing raw meat. Just prior to sealing the oxygen depleted package, an oxygen scavenger is placed in the package to absorb any residual oxygen therein. The oxygen scavenger continues to absorb any oxygen in the package after it has been sealed. A significant advantage of the DelDuca system is that it can operate at exceptionally fast speeds relative to prior art systems that rely solely upon evacuation techniques to diminish oxygen levels. However, in order to maintain such a relatively high throughput, it is important that each portion of the DelDuca system operate quickly and efficiently.

To that end, the present invention provides a system and method for quickly and efficiently inserting an oxygen scavenger into a modified atmosphere package.

SUMMARY OF THE INVENTION

Briefly, the present invention is directed to a unique method and apparatus for inserting an oxygen scavenger into a modified atmosphere package for extending the shelf life of food, especially raw meats.

The inventive apparatus for inserting an oxygen scavenger into a modified atmosphere package includes multiple stations or components. The apparatus includes a scavenger feeding means for feeding a chain of interconnected oxygen scavengers. A separating means separates the oxygen scavenger located at an exposed end of the chain of interconnected oxygen scavengers from the chain of interconnected oxygen scavengers. Optionally, the apparatus employs an injecting means for injecting the oxygen scavenger located at the exposed end of the chain of interconnected oxygen scavengers with an oxygen uptake accelerator to activate the oxygen scavenger at the exposed end prior to separating the oxygen scavenger from the chain of interconnected oxygen scavengers. An adhesive application means applies adhesive to the oxygen scavenger which has been separated from the chain of interconnected oxygen scavengers. A conveyor means conveys the separated oxygen scavenger to a position which is adjacent to a film layer which is used to form an outer package. The oxygen scavenger is attached to a surface of the film layer by the adhesive. The film layer is subsequently formed into a container portion of the modified atmosphere package so that the oxygen scavenger is contained therein.

The inventive method for inserting an oxygen scavenger into a modified atmosphere package involves multiple steps. First, a chain of interconnected oxygen scavengers is provided. Next, the oxygen scavenger which is located at an exposed end of the chain of interconnected oxygen scavengers is separated from the chain. Optionally, the oxygen scavenger located at the exposed end of the chain of interconnected oxygen scavengers is injected with an oxygen uptake accelerator to activate the oxygen scavenger located at the exposed end prior to separating the oxygen scavenger from the chain of interconnected oxygen scavengers. Adhesive is then applied to the oxygen scavenger which has been separated from the chain of interconnected oxygen scavengers. The separated oxygen scavenger is then conveyed to a position which is adjacent to a film layer that is used to form an outer package so that the oxygen scavenger is attached to a surface of the film layer by the adhesive. The film layer which now has the oxygen scavenger attached thereto is then formed into a container portion of the modified atmosphere package so that the oxygen scavenger is contained therein.

The above summary of the present invention is not intended to represent each embodiment or every aspect of the present invention. This is the purpose of the figures and detailed description which follow.

BRIEF DESCRIPTION OF THE DRAWINGS

Other objects and advantages of the invention will become apparent upon reading the following detailed description and upon reference to the drawings in which:

FIG. 3 is an isometric view of a modified atmosphere package into which the oxygen scavenger is inserted by the method and apparatus of the present invention;

FIG. 4 is a section view taken generally along line 4—4 in FIG. 3; and FIG. 5 is an enlarged view of dotted circled portion FIG. 5 in FIG. 4.

Figure 1:
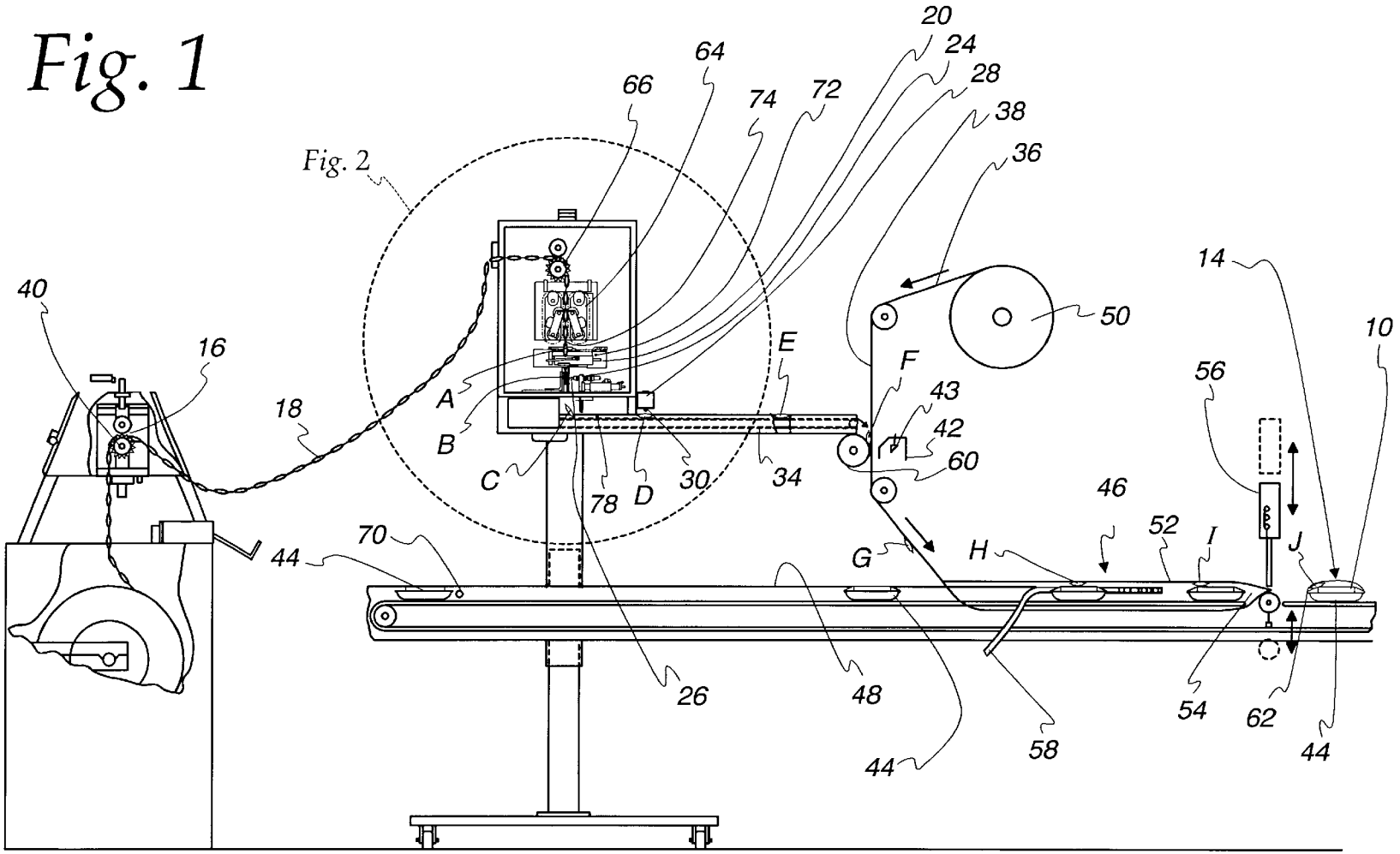
FIG. 1 is a side view of an apparatus for inserting an oxygen scavenger into a modified atmosphere package.

While the invention is susceptible to various modifications and alternative forms, certain specific embodiments thereof have been shown by way of example in the drawings and will be described in detail. It should be understood, however, that the intention is not to limit the invention to the particular forms described. On the contrary, the intention is to cover all modifications, equivalents, and alternatives falling within the spirit and scope of the invention as defined by the appended claims.

DESCRIPTION OF ILLUSTRATIVE EMBODIMENTS

Figure 2:
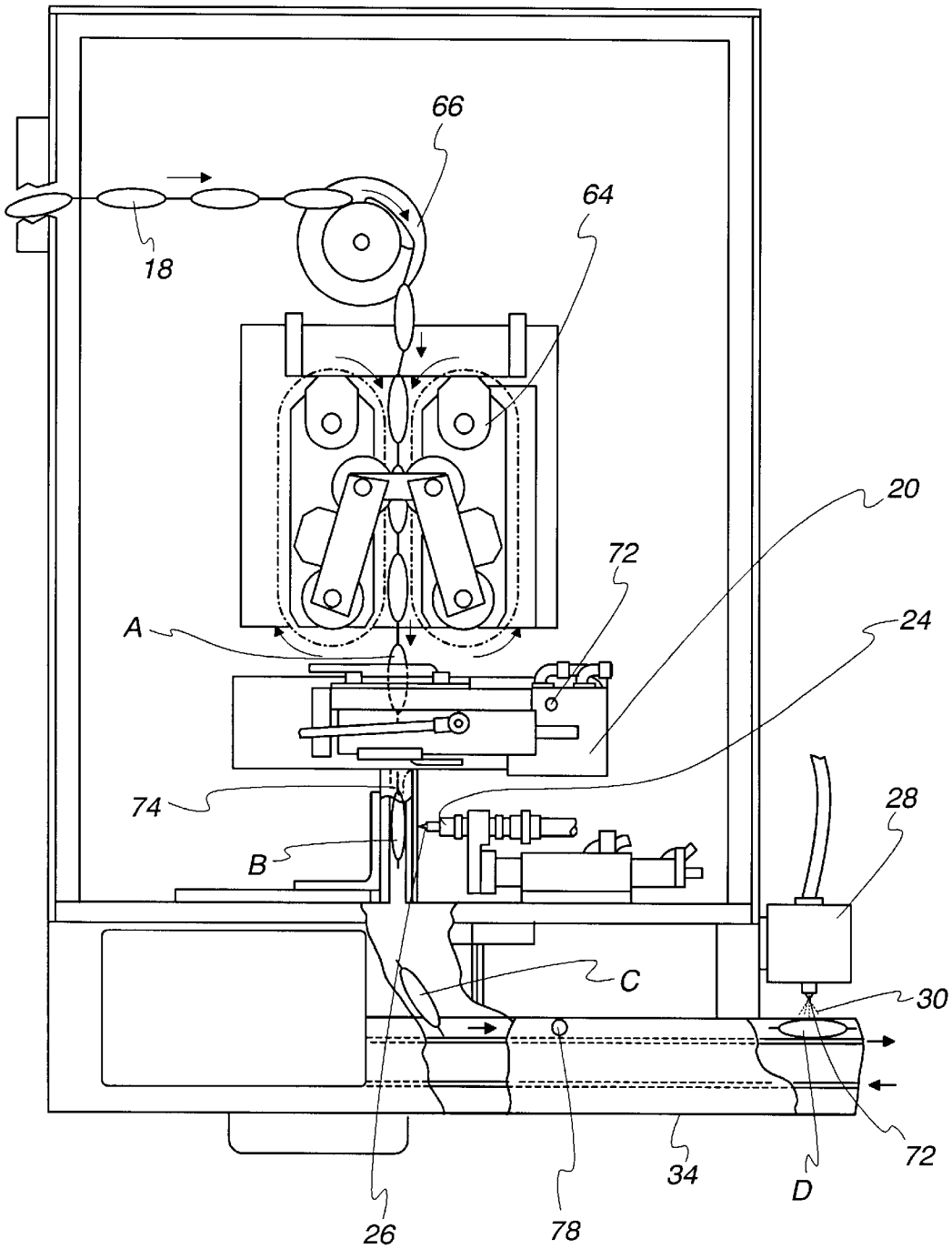
FIG. 2 is an enlarged view of dotted circled portion FIG. 2 in FIG. 1.

Turning now to the drawings, FIG. 1 depicts an inventive apparatus and method for inserting an oxygen scavenger 32 into a modified atmosphere package 14. FIG. 2 depicts an enlarged view of dotted portion FIG. 2 of FIG. 1.

As illustrated in FIGS. 1–2, the inventive apparatus for inserting the oxygen scavenger 32 into the modified atmosphere package 14 includes multiple stations or components. The apparatus includes a first scavenger feeding means 16 for feeding a chain of interconnected oxygen scavengers 18. A separating means 20 separates the oxygen scavenger 32 at position B that is located at an exposed end of the chain of interconnected oxygen scavengers 18 from the chain of interconnected oxygen scavengers 18. The apparatus optionally employs an injecting means 24 for injecting the oxygen scavenger 32 at position B which is located at the exposed end of the chain of interconnected oxygen scavengers 18 with an oxygen uptake accelerator 26 to activate the oxygen scavenger 32 prior to separating the oxygen scavenger from the chain of interconnected oxygen scavengers 18. A conveyer means 34 conveys the separated oxygen scavenger 32 at position C to an adhesive application means 28. The adhesive application means 28 applies adhesive 30 to the oxygen scavenger 32 at position D which has been separated from the chain of interconnected oxygen scavengers 18. The conveyor means 34 conveys the adhesive-carrying oxygen scavenger 32 at position E to position F which is adjacent to a film layer 36 used to form an outer package 10. The adhesive-carrying oxygen scavenger 32 at position F is attached to a surface 38 of the film layer 36 by the adhesive 30. The film layer 36 which now has the oxygen scavenger attached thereto is subsequently formed into the outer package 10 so that the oxygen scavenger 32 at position J is contained within the outer package 10 but is external to any food-filled inner package 44 which may be placed within the outer package 10. The modified atmosphere package 14 is a combination of the outer package 10, the oxygen scavenger 32, and the food-filled inner package 44. The inventive apparatus for inserting the oxygen scavenger 32 into the modified atmosphere package 14 can produce modified atmosphere packages 14 at cycle rates ranging from about 20 to about 60 packages per minute.

The first scavenger feeding means 16 which feeds the chain of interconnected oxygen scavengers 18 includes a rotatable spool 40 about which the chain of interconnected oxygen scavengers 18 is wound. The spool 40 feeds the chain of interconnected oxygen scavengers 18 as it rotates.

The separating means 20 which separates the oxygen scavenger 32 at position B that is located at the exposed end of the chain of interconnected oxygen scavengers 18 from the chain includes a blade. The blade is preferably a pneumatic blade. It is also contemplated, however, that any separating means which is capable of separating the oxygen scavenger 32 at position B from the chain of interconnected oxygen scavengers 18 may be employed. In one embodiment, a second scavenger feeding means 64 is employed. The second scavenger feeding means 64 includes a rotatable spool 66 which assists in directing the chain of interconnected oxygen scavengers 18 to the separating means 20.

The injecting means 24 which injects the oxygen scavenger 32 at position B with an oxygen uptake accelerator 26 includes a hypodermic needle. The injection preferably occurs prior to separating the oxygen scavenger 32 at position B from the chain of interconnected oxygen scavengers 18. It is contemplated, however, that the injection may take place after the oxygen scavenger 32 is separated from the chain of interconnected oxygen scavengers 18. The injection of the oxygen uptake accelerator 26 activates the oxygen scavenger so that the oxygen scavenger may remove residual oxygen from the modified atmosphere package 14 into which the oxygen scavenger is ultimately inserted (see oxygen scavenger 32 at position B in FIG. 1). The injection preferably takes place either immediately before or up to two minutes after the forming of the modified atmosphere package 14 to ensure that the oxygen scavenger can effectively remove residual oxygen from the modified atmosphere package 14. The injecting means 24 applies from about 0.5 mL to about 2 mL of oxygen uptake accelerator 26 to the oxygen scavenger 32 at position B. The amount of oxygen uptake accelerator 26 which is necessary to ensure that the oxygen scavenger can effectively remove residual oxygen from the modified atmosphere package 14 depends on the size of the oxygen scavenger 32. The conveyor means 34 conveys the separated oxygen scavenger 32 at position C to the adhesive application means 28.

The adhesive application means 28 is a mechanical glue applicator that applies from about 0.1 g to about 0.3 g of adhesive 30 to the separated oxygen scavenger 32 at position D which is positioned beneath the applicator. A minimum of 0.05 g glue is necessary to ensure that the oxygen scavenger 32 at position D becomes attached to the surface 38 of the film layer 36. The adhesive 30 is a food-grade adhesive such as Duro Tak # 70-8507 commercially available from National Starch & Chemical of Bridgewater, N.J.

The conveyor means 34 conveys the adhesive-carrying oxygen scavenger 32 at position E to position F which is adjacent to the film layer 36. The conveyor means 34 includes a conveyor belt. The conveyor means 34 also includes a rotating roller 60 which presses the adhesive-carrying oxygen scavenger 32 at position F onto the surface 38 of the film layer 36. A counterweight 42 located opposite the rotating roller 60 presses the adhesive-carrying oxygen scavenger 32 at position F onto the surface 38 of the film layer 36. The counterweight 42, which is balanced on a pivot support 43, is truncated so that it is lighter on the side adjacent the film layer 36. The counterweight 42 uses gravity to apply pressure to press the film layer 36 and the adhesive-carrying oxygen scavenger 32 together. The counterweight 42 pivots to allow the adhesive-carrying oxygen scavenger 32 to pass along the rotating roller 60.

Simultaneously, a rotating conveyor 48 conveys a food-filled inner package 44 toward the film layer 36. The film layer 36 carries the oxygen scavenger 32 at position G which is adhesively attached thereto toward the approaching food-filled inner package 44 as the film layer 36 is released from a rotating film roll 50.

The inventive apparatus for inserting the oxygen scavenger 32 into the modified atmosphere package 14 involves the use of sensors in multiple locations. The term "sensor" as used herein shall be defined as any device which responds to a signal or stimulus, including an electric eye, a photo eye, or a photoelectric cell.

The cycle of inserting the oxygen scavenger 32 into the modified atmosphere package 14 begins by threading the chain of interconnected oxygen scavengers 18 through the first scavenger feeding means 16 and the second scavenger feeding means 64 to a point where the oxygen scavenger 32 at position B is aligned with the injecting means 24. Once a first sensor 70 located on the rotating conveyor 48 detects the presence of a food filled-inner package 44 being conveyed along the rotating conveyor 48, the cycle of inserting the oxygen scavenger 32 into the modified atmosphere package 14 is initiated. Specifically, the injecting means 24 begins firing into the oxygen scavenger 32 in position B. The injecting means 24 then injects the oxygen scavenger 32 with oxygen uptake accelerator 26. Once the oxygen scavenger 32 becomes injected with the oxygen uptake accelerator 26, the injecting means 24 is retracted. Once the injecting means 24 is retracted, the separating means 20 separates the oxygen scavenger 32 from the chain of interconnected oxygen scavengers 18. The separated oxygen scavenger at position C then drops onto the conveyor means 34.

Once the oxygen scavenger 32 at position C is dropped onto the conveyor means 34, a second sensor 78 located on the conveyor means 34 detects the presence of the oxygen scavenger 32 at position C and signals the adhesive application means 28 to release adhesive 30 onto the oxygen scavenger 32 at position D. The conveyor means 34 then continues to convey the adhesive-carrying oxygen scavenger 32 at position E along the conveyor to a rotating roller 60. The counterweight 42 located opposite the rotating roller 60 presses the adhesive-carrying oxygen scavenger 32 at position F against the film layer 36.

Shortly after the separating means 24 separates the oxygen scavenger 32 at position B from the chain of interconnected oxygen scavengers 18, the first and second scavenger feeding means 16, 64 pull the chain of interconnected oxygen scavengers 18 forward until a third sensor 72, which is located above the separating means 20, detects a sealed area 74 between the oxygen scavenger 32 at position A and the oxygen scavenger 32 at position B. The first and second scavenger feeding means 16, 64 then advance the chain of interconnected scavengers 18 by a preset increment sufficient to align the oxygen scavenger 32 at position B with the injecting means 24 and the sealed area 74 with the separating means 20. Once the oxygen scavenger 32 at position B becomes aligned with the injecting means 24 and the sealed area 74 becomes aligned with the separating means 20, the first and second scavenger feeding means 16, 64 are stopped to await a signal from first sensor 70 that the first sensor 70 has detected the presence of another food-filled inner package 44.

Using the sensors 70, 72, 78 in conjunction with the speeds of the conveyor means 34, the rotating conveyor 48, and the second scavenger feeding means 64, a single oxygen scavenger 32 from the conveyor means 34 becomes associated with a single food-filled inner package 44 from the rotating conveyor 48. It is also contemplated that the sensors 70, 72, 78 and the speeds of the conveyor means 34, the rotating conveyor 48, and the second scavenger feeding means 64 can be adjusted to correspond the delivery of more than one oxygen scavenger 32 to more than one food-filled inner packages 44 depending on the oxygen removal capacity of the oxygen scavenger 32 and the type of food stored within the modified atmosphere package 14.

Once the oxygen scavenger 32 at position G which is adhesively attached to the film layer 36 is adjacent to the associated food-filled inner package 44, they are conveyed along the rotating conveyor 48 to a forming station 46. At the forming station 46, the outer package 10 is formed by encompassing the film layer 36 carrying the oxygen scavenger 32 at position H about the food-filled inner package 44. The oxygen scavenger 32 at position I becomes contained within the outer package 10 but external to the food-filled inner package 44. After the film layer 36 encompasses the food-filled inner package 44, the encompassing film layer 52 is sealed at one end 54 with a vertically-oscillating sealing mechanism 56. The sealing mechanism is preferably a heat sealing mechanism. After the one end 54 of the encompassing film layer 52 is sealed, a mixture of gases flushes the pocket inside of the encompassing film layer 52 but external to the inner package 44 to substantially remove oxygen from that region. The gas flushing mixture is typically about 30 percent carbon dioxide and about 70 percent nitrogen. The mixture of carbon dioxide and nitrogen emanates from a conventional gas supply hollow tube or rod 58 fed by a gas tank (not shown). By flushing the region inside of the encompassing film layer 52, the pocket between the outer package 10 and the inner package 44 becomes substantially free of oxygen.

Once the oxygen removal is completed, the rotating conveyor 48 conveys the oxygen scavenger 32 at position I and the food-filled inner package 44 which are now within the encompassing film layer 52 that is sealed at one end 54 past the vertically-oscillating sealing mechanism 56. The vertically-oscillating sealing mechanism 56 then seals the other end 62 of the encompassing film layer 52 which encompasses the oxygen scavenger 32 at position J and the food-filled inner package 44. The activated oxygen scavenger 32 at position J present within the outer package 10 removes any residual oxygen that remains within the modified atmosphere package 14. The modified atmosphere package 14 comprises the outer package 10, the oxygen scavenger 32 at position J, and the food-filled inner package 44.

FIGS. 3–5 depict the modified atmosphere package 14 including the outer package 10 and the food-filled inner package 44. The term "package" as used herein shall be defined as any means for holding raw meat, including a container, carton, casing, parcel, holder, tray, flat, bag, film envelope, etc. At least a portion of the inner package 44 is permeable to oxygen. The inner package 44 includes a conventional semi-rigid plastic tray 80 thermoformed from a sheet of polymeric material which is substantially permeable to oxygen. Exemplary polymers which may be used to form the non-barrier tray 80 include polystyrene foam, cellulose pulp, polyethylene, polypropylene, etc. The inner package 44 further includes a stretch film wrapping or cover 82 substantially composed of a polymeric material, such as polyvinyl chloride (PVC), which is substantially permeable to oxygen. Small holes may be punched into the film to assist in achieving a high rate of permeability.

The tray 80 is generally rectangular in configuration and includes a bottom wall 84, a continuous side wall 86, and a continuous rim or flange 88. The continuous side wall 86 encompasses the bottom wall 84 and extends upwardly and outwardly from the bottom wall 84. The continuous rim 88 encompasses an upper edge of the continuous side wall 86 and projects laterally outwardly therefrom. A food item such as a retail cut of raw meat 90 is located in a rectangular compartment defined by the bottom wall 84 and continuous side wall 86. The raw meat may be any animal protein, including beef, pork, veal, lamb, chicken, turkey, venison, fish, etc.

The outer package 10 is preferably a flexible polymeric bag composed of a single or multilayer plastics material which is substantially impermeable to oxygen. The polymeric bag may, for example, include a multilayer coextruded film containing ethylene vinyl chloride (EVOH) or include an oriented polypropylene (OPP) core coated with an oxygen barrier coating such as polyvinylidene chloride and further laminated with a layer of sealant material such as polyethylene to facilitate heat sealing.

The oxygen scavenger 32 is designed to reduce any residual oxygen in the modified atmosphere package 14 at a rate sufficient to prevent discoloration (e.g., browning) of the raw meat 90. Such residual oxygen may be located in the pocket between the outer package 10 and the inner package 44 or may still be trapped within the inner package 44. The oxygen scavenger 32 also absorbs any oxygen which might permeate into the outer package 10 from the ambient environment. The oxygen scavenger 32 may be activated with an oxygen uptake accelerator 26 to increase the rate of oxygen uptake. The oxygen uptake accelerator 26 is preferably selected from the group consisting of water or aqueous solutions of acetic acid, citric acid, sodium chloride, calcium chloride, magnesium chloride and copper. Further information concerning the oxygen scavenger 32, the oxygen uptake accelerator 26, and the means for introducing the oxygen uptake accelerator 26 to the oxygen scavenger 32 may be obtained from application Ser. No. 08/856,448 (U.S. Pat. No. 5,928,560), which is incorporated herein by reference. One preferred oxygen scavenger is a FreshPax™ oxygen absorbing packet commercially available from MultiSorb Technologies, Inc. (formerly Multiform Desiccants Inc.) of Buffalo, N.Y.

The retail cut of raw meat 90 within the modified atmosphere package 14 takes on a purple-red color when the oxygen is removed from the interior of the modified atmosphere package 14. The meat-filled modified atmosphere package 14 may be stored in a refrigeration unit for several weeks prior to being offered for sale at a grocery store. A short time (e.g., less than one hour) prior to being displayed at the grocery store, the inner package 44 is removed from the outer package 10 to allow oxygen from the ambient environment to permeate the non-barrier tray 80 and non-barrier cover 82. The purple-red color of the raw meat 90 quickly changes or "blooms" to a generally acceptable bright red color when the raw meat 90 is oxygenated by exposure to air.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A method for inserting an activated oxygen scavenger into a modified atmosphere package comprising:

providing a chain of interconnected oxygen scavengers;

injecting an oxygen uptake accelerator into an oxygen scavenger located at an exposed end of said chain interconnected oxygen scavengers to activate said oxygen scavenger;

separating said oxygen scavenger located at said exposed end of said chain of interconnected oxygen scavengers from said chain of interconnected oxygen scavengers;

applying adhesive to said separated oxygen scavenger;

conveying said oxygen scavenger to a position adjacent to a film layer used to form a container portion of said modified atmosphere package such that said separated oxygen scavenger is attached to a surface of said film layer by said adhesive;

flushing said container portion with at least one gas to substantially remove oxygen from said container portion; and forming said film layer having said separated oxygen scavenger attached thereto into said container portion of said modified atmosphere package.

2. The method of claim 1 wherein the step of providing said chain of interconnected oxygen scavengers includes winding said chain of interconnected oxygen scavengers about a rotatable spool and feeding said chain of interconnected oxygen scavengers from said spool.

3. The method of claim 1 wherein the step of separating is accomplished with a blade.

4. The method of claim 3 wherein the blade is a pneumatic blade.

5. The method of claim 1 wherein the step of applying said adhesive is accomplished with a mechanical glue applicator.

6. The method of claim 1 wherein the step of forming said film layer into said modified atmosphere package includes forming said package about a food-filler inner package at a forming station.

7. The method of claim 6 wherein the step of conveying said oxygen scavenger to a position adjacent to said film layer is timed using one or more sensors to correspond the delivery of said oxygen scavenger with the delivery of the food-filled inner package to the forming station.

8. The method of claim 1 wherein the step of conveying said oxygen scavenger to a position adjacent to said film layer is timed such that a single oxygen scavenger is inserted into said modified atmosphere package.

9. The method of claim 1 wherein the step of conveying said oxygen scavenger to a position adjacent to said film layer includes pressing said oxygen scavenger containing said adhesive onto said film layer.

10. The method of claim 1 wherein the step of conveying said oxygen scavenger to a position adjacent to said film layer employs a conveyor belt.

11. The method of claim 1 wherein the step of injecting is accomplished with a hypodermic needle.

12. The method of claim 1 wherein the step of injecting said oxygen scavenger occurs prior to the step of separating said oxygen scavenger from said chain of interconneted oxygen scavengers.

13. The method of claim 1 wherein said oxygen uptake accelerator is selected from the group consisting of water or aqueous solutions of acetic acid, citric acid, sodium chloride, calcium chloride, magnesium chloride and copper.

14. The method of claim 1 wherein said oxygen update accelerator is present in said packet in an amount between about 0.5 mL to about 2.0 mL.

15. The method of claim 1 wherein said flushing includes substantially eliminating oxygen from said container portion by pointing a hollow element into said container portion.

16. The method of claim 15 wherein said hollow element is a gas supply hollow tube.

17. An apparatus for inserting an activated oxygen scavenger into a modified atmosphere package comprising:

scavenger feeding means for feeding a chain of interconnected oxygen scavengers;

injecting means for injecting an oxygen uptake accelerator into an oxygen scavenger located at an exposed end of said chain of interconnected oxygen scavengers to activate said oxygen scavenger;

separating means for separating said oxygen scavenger located at said exposed end of said chain of interconnected oxygen scavengers from said chain of interconnected oxygen scavengers;

adhesive application means for applying adhesive to said separated oxygen scavenger;

conveyor means for conveying said separated oxygen scavenger to a position adjacent to a film layer such that said separated oxygen scavenger is attached to a surface of said film layer by said adhesive, said film layer being subsequently attached onto a container portion of said modified atmosphere package; and flushing means for removing oxygen from said container portion before said film layer is attached onto said container portion.

18. The apparatus of claim 14 wherein the scavenger feeding means includes a spool about which said chain of interconnected oxygen scavengers is wound.

19. The apparatus of claim 17 wherein the separating means includes a blade.

20. The apparatus of claim 16 wherein the blade is pneumatically actuated.

21. The apparatus of claim 17 wherein the adhesive application means includes a mechanical glue applicator.

22. The apparatus of claim 14 wherein the injecting means injects said oxygen scavenger prior to its separation from said chain of interconnected oxygen scavengers.

23. The apparatus of claim 17 wherein the injecting means includes a hypodermic needle.

24. The apparatus of claim 14 wherein the injection means injects the oxygen scavenger prior to its separation from the chain of interconnected oxygen scavengers.

25. The method of claim 14 wherein said oxygen update accelerator is present in said oxygen scavenger in an amount between about 0.5 mL to about 2.0 mL.

26. The apparatus of claim 14 wherein said oxygen uptake accelerator is selected from the group consisting of water or aqueous solutions of acetic acid, citric acid, sodium chloride, calcium chloride, magnesium chloride and copper.

27. The apparatus of claim 14 wherein said oxygen update accelerator is present in said oxygen scavenger in an amount between 0.5 to about 2.0 mL.

28. The apparatus of claim 14 wherein said flushing means includes substantially eliminating oxygen from said container portion by pointing a hollow element into said container portion.

29. The apparatus of claim 30 wherein said hollow element is a gas supply hollow tube.

* * * * *

UNITED STATES PATENT AND TRADEMARK OFFICE

CERTIFICATE OF CORRECTION

PATENT NO. : 6,321,509 B1 
DATED : November 27, 2001
INVENTOR(S) : DelDuca et al.

It is certified that error appears in the above-identified patent and that said Letters Patent is hereby corrected as shown below:

Column 7,
Line 59, before "interconnected" insert -- of --

Column 8,
Line 24, delete "food-filler" and insert -- food-filled --
Line 52, delete "update" and insert -- uptake --
Line 53, delete "packet" and insert -- oxygen scavenger --

Column 9,
Line 16, delete "14" and insert -- 17 --
Line 21, delete "16" and insert -- 19 --

Column 10,
Line 1, delete "14" and insert -- 17 --
Line 6, delete "14" and insert -- 17 --
Line 6, delete "injection" and insert -- injecting --
Line 7, delete both occurrences of "the" and insert -- said -- for both occurrences
Delete claim 25 and insert claim 19 as claim 25 as follows:

-- 25. The apparatus of claim 17 wherein the conveyor means includes a rotating roller for pressing said oxygen scavenger onto said film layer. --

Line 12, delete "14" and insert -- 17 --
Line 16, delete "update" and insert -- uptake --
Line 16, delete "14" and insert -- 17 --
Line 18, insert -- mL -- after "0.5"
Line 19, delete "14" and insert -- 17 --
Line 23, delete "30" and insert -- 28 --

Signed and Sealed this

Thirteenth Day of August, 2002

*Attest:*

*Attesting Officer*

JAMES E. ROGAN
*Director of the United States Patent and Trademark Office*